US011549686B2

(12) United States Patent
Gandikota et al.

(10) Patent No.: US 11,549,686 B2
(45) **Date of Patent: *Jan. 10, 2023**

(54) COMBUSTOR FOR A GAS TURBINE ENGINE

(71) Applicant: General Electric Company, Schenectady, NY (US)

(72) Inventors: Gurunath Gandikota, Bangalore (IN); Hiranya Kumar Nath, Bangalore (IN); Michael Anthony Benjamin, Cincinnati, OH (US); Daniel J. Kirtley, Blue Ash, OH (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/751,886

(22) Filed: May 24, 2022

(65) Prior Publication Data

US 2022/0282867 A1 Sep. 8, 2022

Related U.S. Application Data

(63) Continuation of application No. 17/166,687, filed on Feb. 3, 2021, now Pat. No. 11,371,701.

(51) Int. Cl.
*F23R 3/00* (2006.01)

(52) U.S. Cl.
CPC .... *F23R 3/002* (2013.01); *F23R 2900/00012* (2013.01); *F23R 2900/00017* (2013.01); *F23R 2900/03042* (2013.01)

(58) Field of Classification Search
CPC ..... F23R 3/002; F23R 3/004; F23R 3/045; F23R 3/06; F23R 2900/00017; F23R 2900/03042; F23R 2900/00012
See application file for complete search history.

(56) References Cited

U.S. PATENT DOCUMENTS

| | | | |
|---|---|---|---|
| 3,545,202 | A | 12/1970 | Batt et al. |
| 3,767,122 | A | 10/1973 | Sedgwick |
| 3,974,647 | A | 8/1976 | Lewis et al. |
| 3,978,662 | A | 9/1976 | DuBell et al. |
| 4,485,630 | A | 12/1984 | Kenworthy |
| 4,622,821 | A | 11/1986 | Madden |

(Continued)

FOREIGN PATENT DOCUMENTS

| | | | |
|---|---|---|---|
| EP | 2463582 | A2 | 6/2012 |
| EP | 3412972 | A1 | 12/2018 |

(Continued)

*Primary Examiner* — Todd E Manahan
*Assistant Examiner* — Rodolphe Andre Chabreyrie
(74) *Attorney, Agent, or Firm* — Dority & Manning, P.A.

(57) ABSTRACT

A combustor for a gas turbine engine includes a forward liner segment and an aft liner segment positioned downstream from the forward liner segment relative to a direction of flow through the combustor. The forward and aft liner segments at least partially define a combustion chamber. Furthermore, the combustor includes a dilution slot frame positioned between the forward and aft liner segments along a longitudinal centerline of the gas turbine engine. Moreover, the dilution slot frame defines a plurality of dilution slots spaced apart from each other along a circumferential direction of the gas turbine engine such that the plurality of dilution slots provides an annular ring of dilution air to the combustion chamber.

20 Claims, 8 Drawing Sheets

(56) References Cited

U.S. PATENT DOCUMENTS

| | | | |
|---|---|---|---|
| 4,896,510 | A | 1/1990 | Foltz |
| 4,901,522 | A | 2/1990 | Commaret et al. |
| 4,916,906 | A | 4/1990 | Vogt |
| 6,553,767 | B2 | 4/2003 | Farmer et al. |
| 7,032,386 | B2 | 4/2006 | Mandai et al. |
| 7,059,133 | B2 | 6/2006 | Gerendas |
| 7,246,993 | B2 | 7/2007 | Bolms et al. |
| 7,464,553 | B2 | 12/2008 | Hsieh et al. |
| 7,726,131 | B2 | 6/2010 | Sze et al. |
| 7,802,431 | B2 | 9/2010 | Parker |
| 8,109,099 | B2 | 2/2012 | Tu et al. |
| 8,276,391 | B2 | 10/2012 | Berry et al. |
| 8,307,656 | B2 | 11/2012 | Tuthill |
| 8,307,657 | B2 | 11/2012 | Chila |
| 9,010,121 | B2 | 4/2015 | Taylor et al. |
| 9,182,122 | B2 | 11/2015 | Matthews et al. |
| 9,310,079 | B2 | 4/2016 | Uskert |
| 9,718,735 | B2 | 8/2017 | Delvaux et al. |
| 9,765,968 | B2 | 9/2017 | Gage et al. |
| 10,094,564 | B2 | 10/2018 | Lebel |
| 10,107,128 | B2 | 10/2018 | Romanov et al. |
| 10,337,737 | B2 | 7/2019 | Holdercraft et al. |
| 10,520,192 | B2 | 12/2019 | Shim et al. |
| 10,533,746 | B2 | 1/2020 | Rimmer et al. |
| 10,577,944 | B2 | 3/2020 | Clark et al. |
| 10,634,350 | B2 | 4/2020 | Harding et al. |
| 10,684,017 | B2 | 6/2020 | Moura et al. |
| 10,718,521 | B2 | 7/2020 | Quach et al. |
| 10,731,858 | B2 | 8/2020 | Bouldin et al. |
| 10,801,726 | B2 | 10/2020 | Stevens et al. |
| 10,801,727 | B2 | 10/2020 | DeBruhl et al. |
| 10,830,143 | B2 | 11/2020 | Choi |
| 2008/0271457 | A1 | 11/2008 | McMasters et al. |
| 2009/0241505 | A1 | 10/2009 | Dinu |
| 2010/0272953 | A1 | 10/2010 | Yankowich et al. |
| 2013/0269359 | A1 | 10/2013 | Hughes |
| 2014/0033723 | A1 | 2/2014 | Doerr et al. |
| 2015/0135719 | A1 | 5/2015 | Gerendas |
| 2016/0131364 | A1 | 5/2016 | Burd |
| 2016/0178199 | A1 | 6/2016 | Burd |
| 2016/0209033 | A1 | 7/2016 | Burd |
| 2018/0306440 | A1 | 10/2018 | Spence et al. |
| 2019/0024894 | A1 | 1/2019 | Mongillo et al. |
| 2019/0063320 | A1 | 2/2019 | Choi |
| 2019/0101289 | A1 | 4/2019 | Mongillo, Jr. et al. |
| 2019/0170352 | A1 | 6/2019 | Wilson et al. |

FOREIGN PATENT DOCUMENTS

| | | | |
|---|---|---|---|
| EP | 3447381 | A1 | 2/2019 |
| GB | 2569449 | A | 6/2019 |
| KR | 101759707 | B1 | 7/2017 |
| WO | WO2008/137201 | A1 | 11/2008 |

COMBUSTOR FOR A GAS TURBINE ENGINE

CROSS REFERENCE TO RELATED APPLICATIONS

This application is a continuation of and claims the right of priority to U.S. patent application Ser. No. 17/166,687, filed Feb. 3, 2021, the disclosure of which is hereby incorporated by reference herein in its entirety for all purposes.

FIELD

The present disclosure generally pertains to gas turbine engines, and, more specifically, to a combustor for a gas turbine engine.

BACKGROUND

A gas turbine engine generally includes a compressor section, a combustion section, and a turbine section. More specifically, the compressor section progressively increases the pressure of air entering the gas turbine engine and supplies this compressed air to the combustion section. The compressed air and fuel are mixed and burned within the combustion section to generate high-pressure and high-temperature combustion gases. The combustion gases flow through the turbine section before exiting the engine. In this respect, the turbine section converts energy from the combustion gases into rotational mechanical energy. This mechanical energy is, in turn, used to rotate one or more shafts, which drive the compressor section and/or a fan assembly of the gas turbine engine.

In general, the combustor section includes an annular combustor. Each combustor, in turn, includes an inner liner, an outer liner, and a plurality of fuel nozzles. Specifically, the inner and outer liners define a combustion chamber therebetween. As such, the fuel nozzle(s) supply the fuel and air mixture to the combustion chamber for combustion therein.

In some configurations, the inner and/or outer liners define a plurality of dilution holes positioned downstream of the fuel nozzle(s). The dilution holes, in turn, supply additional air to the combustion chamber to mix with the combustion products coming from the primary zone of the combustion chamber and complete the combustion process rapidly, thereby reducing $NO_x$ (oxides of nitrogen) emissions. However, such dilution holes are generally spaced apart from each other around the circumference of the liners.

Accordingly, an improved combustor for a gas turbine engine would be welcomed in the technology.

BRIEF DESCRIPTION

Aspects and advantages of the invention will be set forth in part in the following description, or may be obvious from the description, or may be learned through practice of the invention.

In one aspect, the present subject matter is directed to a combustor for a gas turbine engine. The gas turbine engine, in turn, defines a longitudinal centerline, a radial direction extending orthogonally outward from the longitudinal centerline, and a circumferential direction extending concentrically around the longitudinal direction. The combustor includes a forward liner segment and an aft liner segment positioned downstream from the forward liner segment relative to a direction of flow through the combustor, with the forward and aft liner segments at least partially defining a combustion chamber. Furthermore, the combustor includes a dilution slot frame positioned between the forward and aft liner segments along the longitudinal centerline. Moreover, the dilution slot frame defines a plurality of dilution slots spaced apart from each other along the circumferential direction such that the plurality of dilution slots provides an annular ring of dilution air to the combustion chamber.

In another aspect, the present subject matter is directed to a gas turbine engine defining a longitudinal centerline, a radial direction extending orthogonally outward from the longitudinal centerline, and a circumferential direction extending concentrically around the longitudinal direction. The gas turbine engine includes a compressor; a turbine; and a combustor. The combustor, in turn, includes a forward liner segment and an aft liner segment positioned downstream from the forward liner segment relative to a direction of flow through the combustor, with the forward and aft liner segments at least partially defining a combustion chamber. Additionally, the combustor includes a dilution slot frame positioned between the forward and aft liners along the longitudinal centerline. Furthermore, the dilution slot frame defines a plurality of dilution slots spaced apart from each other along the circumferential direction such that the plurality of dilution slots provides an annular ring of dilution air to the combustion chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
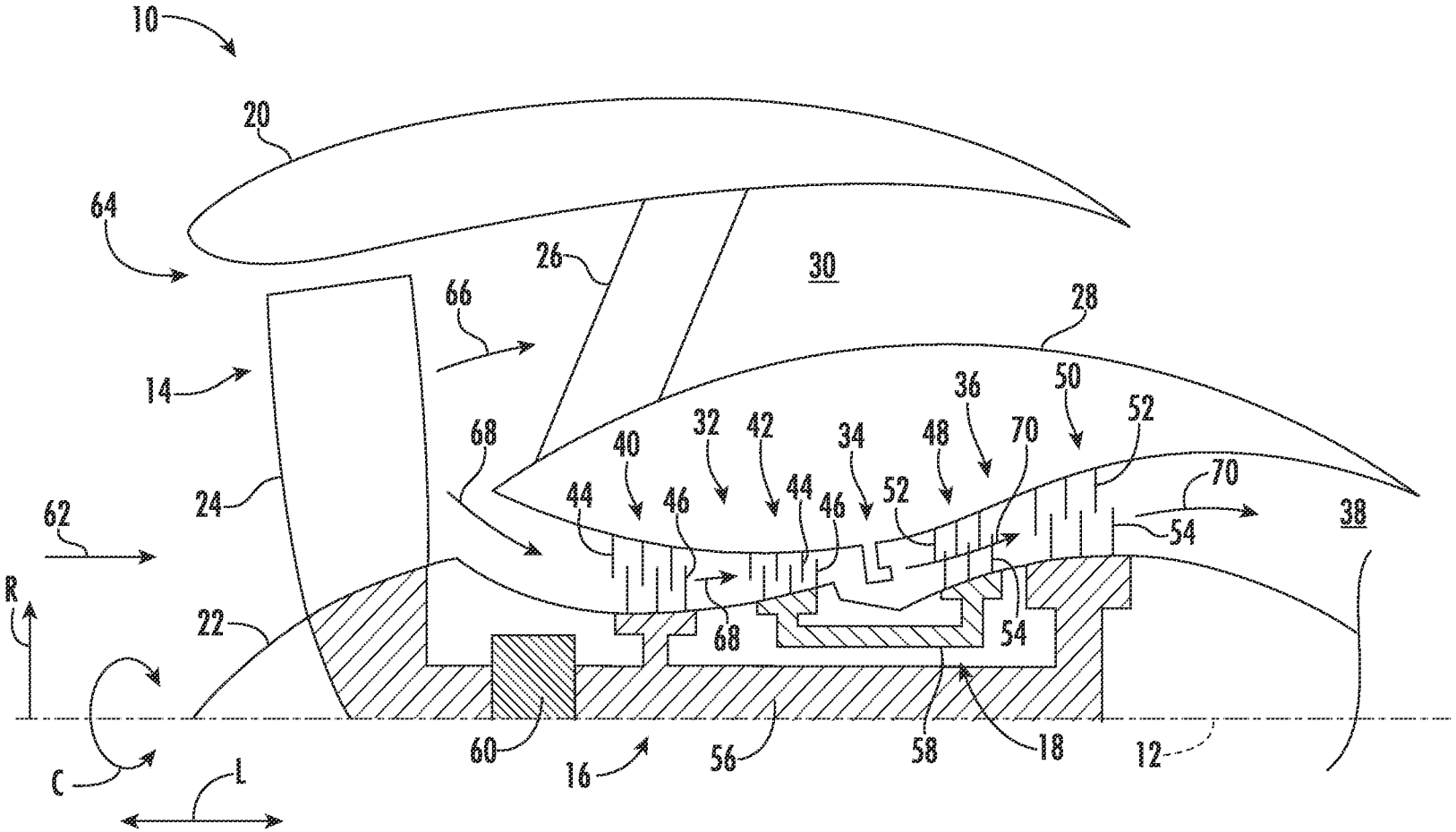
FIG. 1 is a schematic cross-sectional view of one embodiment of a gas turbine engine.

Repeat use of reference characters in the present specification and drawings is intended to represent the same or analogous features or elements of the present invention.

DETAILED DESCRIPTION

Reference now will be made in detail to exemplary embodiments of the presently disclosed subject matter, one or more examples of which are illustrated in the drawings. Each example is provided by way of explanation and should not be interpreted as limiting the present disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

As used herein, the terms "first", "second", and "third" may be used interchangeably to distinguish one component from another and are not intended to signify location or importance of the individual components.

Furthermore, the terms "upstream" and "downstream" refer to the relative direction with respect to fluid flow in a fluid pathway. For example, "upstream" refers to the direction from which the fluid flows, and "downstream" refers to the direction to which the fluid flows.

Additionally, the terms "low," "high," or their respective comparative degrees (e.g., lower, higher, where applicable) each refer to relative speeds within an engine, unless otherwise specified. For example, a "low-pressure turbine" operates at a pressure generally lower than a "high-pressure turbine." Alternatively, unless otherwise specified, the aforementioned terms may be understood in their superlative degree. For example, a "low-pressure turbine" may refer to the lowest maximum pressure turbine within a turbine section, and a "high-pressure turbine" may refer to the highest maximum pressure turbine within the turbine section.

In general, the present subject matter is directed to a combustor for a gas turbine engine. As will be described below, the combustor includes a forward liner segment and an aft liner segment positioned downstream of the forward liner segment. In this respect, the forward and aft liner segments at least partially define a combustion chamber in which a fuel and air mixture is burned to generate combustion gases.

Furthermore, the combustor includes a dilution slot frame positioned between the forward and aft liners along a longitudinal centerline of the engine. In this respect, the dilution slot frame defines a plurality of dilution slots spaced apart from each other along a circumferential direction of the engine. For example, in some embodiments, the dilution frame includes a plurality of frame members separating the dilution slots. Moreover, in several embodiments, the dilution slots are longer (e.g., at least three times longer) in the circumferential direction than in the longitudinal direction. As such, unlike conventional combustors, which provide discrete jets of the dilution air to the combustion chamber, the dilution slots disclosed herein provide an annular ring of dilution air to the combustion chamber. This annular ring of dilution air, in turn, reduces the formation of hot spots within the combustion chamber, thereby allowing a greater reduction in $NO_x$ emissions.

Additionally, in some embodiments, the combustor includes a fence positioned adjacent to dilution slot frame. More specifically, the fence extends along a radial direction into the combustion chamber. As such, the fence directs the dilution air entering the combustion chamber via the dilution slots toward the center of the combustion chamber. Furthermore, the fence increases the turbulence within the combustion chamber. In this respect, the fence provides more quicker and more uniform mixing of the dilution air and the combustor gases, thereby further reducing $NO_x$ emissions.

Referring now to the drawings, FIG. 1 is a schematic cross-sectional view of one embodiment of a gas turbine engine 10. In the illustrated embodiment, the engine 10 is configured as a high-bypass turbofan engine. However, in alternative embodiments, the engine 10 may be configured as a propfan engine, a turbojet engine, a turboprop engine, a turboshaft gas turbine engine, or any other suitable type of gas turbine engine.

As shown in FIG. 1, the engine 10 defines a longitudinal direction L, a radial direction R, and a circumferential direction C. In general, the longitudinal direction L extends parallel to a longitudinal centerline 12 of the engine 10, the radial direction R extends orthogonally outward from the longitudinal centerline 12, and the circumferential direction C extends generally concentrically around the longitudinal centerline 12.

In general, the engine 10 includes a fan 14, a low-pressure (LP) spool 16, and a high pressure (HP) spool 18 at least partially encased by an annular nacelle 20. More specifically, the fan 14 may include a fan rotor 22 and a plurality of fan blades 24 (one is shown) coupled to the fan rotor 22. In this respect, the fan blades 24 are spaced apart from each other along the circumferential direction C and extend outward from the fan rotor 22 along the radial direction R. Moreover, the LP and HP spools 16, 18 are positioned downstream from the fan 14 along the longitudinal centerline 12 (i.e., in the longitudinal direction L). As shown, the LP spool 16 is rotatably coupled to the fan rotor 22, thereby permitting the LP spool 16 to rotate the fan 14. Additionally, a plurality of outlet guide vanes or struts 26 spaced apart from each other in the circumferential direction C extend between an outer casing 28 surrounding the LP and HP spools 16, 18 and the nacelle 20 along the radial direction R. As such, the struts 26 support the nacelle 20 relative to the outer casing 28 such that the outer casing 28 and the nacelle 20 define a bypass airflow passage 30 positioned therebetween.

The outer casing 28 generally surrounds or encases, in serial flow order, a compressor section 32, a combustion section 34, a turbine section 36, and an exhaust section 38. For example, in some embodiments, the compressor section 32 may include a low-pressure (LP) compressor 40 of the LP spool 16 and a high-pressure (HP) compressor 42 of the HP spool 18 positioned downstream from the LP compressor 40 along the longitudinal centerline 12. Each compressor 40, 42 may, in turn, include one or more rows of stator vanes 44 interdigitated with one or more rows of compressor rotor blades 46. Moreover, in some embodiments, the turbine section 36 includes a high-pressure (HP) turbine 48 of the HP spool 18 and a low-pressure (LP) turbine 50 of the LP spool 16 positioned downstream from the HP turbine 48 along the longitudinal centerline 12. Each turbine 48, 50 may, in turn, include one or more rows of stator vanes 52 interdigitated with one or more rows of turbine rotor blades 54.

Additionally, the LP spool 16 includes the low-pressure (LP) shaft 56 and the HP spool 18 includes a high pressure (HP) shaft 58 positioned concentrically around the LP shaft 56. In such embodiments, the HP shaft 58 rotatably couples the rotor blades 54 of the HP turbine 48 and the rotor blades 46 of the HP compressor 42 such that rotation of the HP turbine rotor blades 54 rotatably drives HP compressor rotor blades 46. As shown, the LP shaft 56 is directly coupled to the rotor blades 54 of the LP turbine 50 and the rotor blades 46 of the LP compressor 40. Furthermore, the LP shaft 56 is coupled to the fan 14 via a gearbox 60. In this respect, the rotation of the LP turbine rotor blades 54 rotatably drives the LP compressor rotor blades 46 and the fan blades 24.

In several embodiments, the engine 10 may generate thrust to propel an aircraft. More specifically, during operation, air (indicated by arrow 62) enters an inlet portion 64 of the engine 10. The fan 14 supplies a first portion (indicated by arrow 66) of the air 62 to the bypass airflow passage 30 and a second portion (indicated by arrow 68) of the air 62 to the compressor section 32. The second portion 68 of the air 62 first flows through the LP compressor 40 in which the rotor blades 46 therein progressively compress the second portion 68 of the air 62. Next, the second portion 68 of the air 62 flows through the HP compressor 42 in which the rotor blades 46 therein continue progressively compressing the second portion 68 of the air 62. The compressed second portion 68 of the air 62 is subsequently delivered to the combustion section 34. In the combustion section 34, the second portion 68 of the air 62 mixes with fuel and burns to generate high-temperature and high-pressure combustion gases 70. Thereafter, the combustion gases 70 flow through the HP turbine 48 which the HP turbine rotor blades 54 extract a first portion of kinetic and/or thermal energy therefrom. This energy extraction rotates the HP shaft 58, thereby driving the HP compressor 42. The combustion gases 70 then flow through the LP turbine 50 in which the LP turbine rotor blades 54 extract a second portion of kinetic and/or thermal energy therefrom. This energy extraction rotates the LP shaft 56, thereby driving the LP compressor 40 and the fan 14 via the gearbox 60. The combustion gases 70 then exit the engine 10 through the exhaust section 38.

The configuration of the gas turbine engine 10 described above and shown in FIG. 1 is provided only to place the present subject matter in an exemplary field of use. Thus, the present subject matter may be readily adaptable to any manner of gas turbine engine configuration, including other types of aviation-based gas turbine engines, marine-based gas turbine engines, and/or land-based/industrial gas turbine engines.

Figure 2:
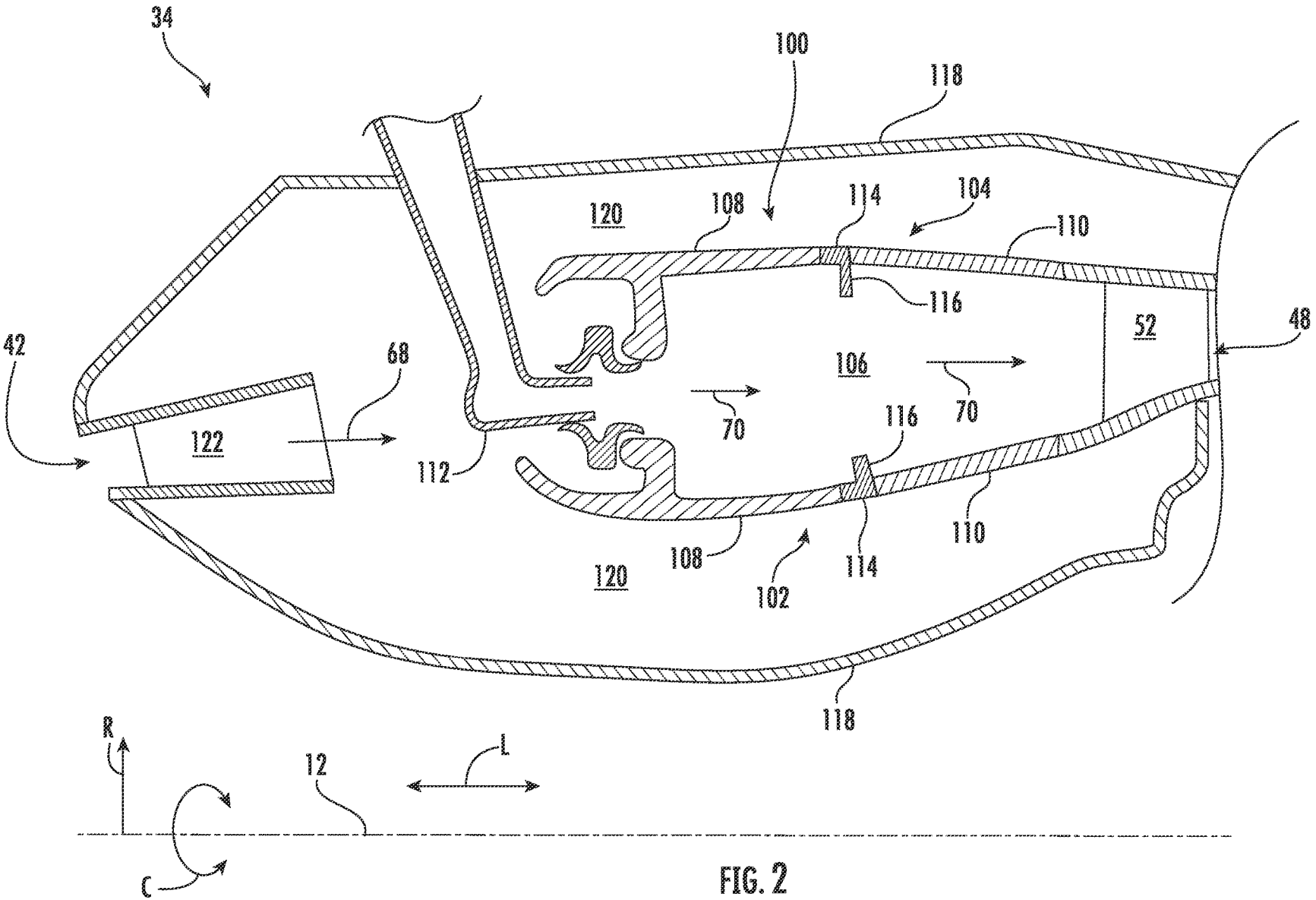
FIG. 2 is a cross-sectional side view of one embodiment of a combustion section of a gas turbine engine.

FIG. 2 is a cross-sectional view of one embodiment of the combustion section 34 of the gas turbine engine 10. As shown, the combustion section 34 includes an annular combustor 100. The combustor 100, in turn, includes an inner liner 102 and an outer liner 104 positioned outward from the inner liner 102 along the radial direction R. In this respect, the inner and outer liners 102, 104 define a combustion chamber 106 therebetween. Each liner 102, 104, in turn, includes a forward liner segment 108 and an aft liner segment 110 positioned downstream of the forward liner segment 108 relative to the direction of flow of the combustion gases 70 through the combustor 100. Moreover, the combustor 100 includes one or more fuel nozzles 112, which supply a mixture of fuel and the compressed air 68 to the combustion chamber 106. The fuel and air mixture burns within the combustion chamber 106 to generate the combustion gases 70. Although FIG. 2 illustrates a single annular combustor 100, the combustion section 34 may, in other embodiments, include a plurality of combustors 100.

In several embodiments, the combustor 100 includes one or more dilution slot frames 114 and/or one or more fences 116 positioned adjacent to the dilution slot frame(s) 114. As will be described below, the dilution slot frame(s) 114 allows dilution air to enter the combustion chamber 106 during operation, which reduces the $NO_x$ emissions of the engine 10. Furthermore, as will be described below, the fence(s) 116 directs the dilution air toward the center of the combustion chamber 106 and increases the turbulence within the combustion chamber 106, thereby further reducing the $NO_x$ emissions of the engine 10. As shown, in the illustrated embodiment, the combustor 100 includes one dilution slot frame 114 positioned between the forward and aft liner segments 108, 110 of the inner liner 102 and another dilution slot frame 114 positioned between the forward and aft liner segments 108, 110 of the outer liner 104. Moreover, in the illustrated embodiment, the combustor 100 includes one fence 116 extending outward in the radial direction R from the inner liner 102 and another fence 116 extending inward in the radial direction R from the outer liner 104. However, in alternative embodiments, the combustor 100 may include any other suitable number of dilution slot frames 114 and/or fences 116.

Additionally, in several embodiments, the combustion section 34 includes a compressor discharge casing 118. In such embodiments, the compressor discharge casing 118 at least partially surrounds or otherwise encloses the combustor(s) 100 in the circumferential direction C. In this respect, a compressor discharge plenum 120 is defined between the compressor discharge casing 118 and the liners 102, 104. The compressor discharge plenum 120 is, in turn, configured to supply compressed air to the combustor(s) 100. Specifically, as shown, the compressed air 68 exiting the HP compressor 42 is directed into the compressor discharge plenum 120 by an inlet guide vane 122. The compressed air 68 within the compressor discharge plenum 120 is then supplied to the combustion chamber(s) 106 of the combustor(s) 100 by the fuel nozzle(s) 112 for use in combusting the fuel.

Figure 3:
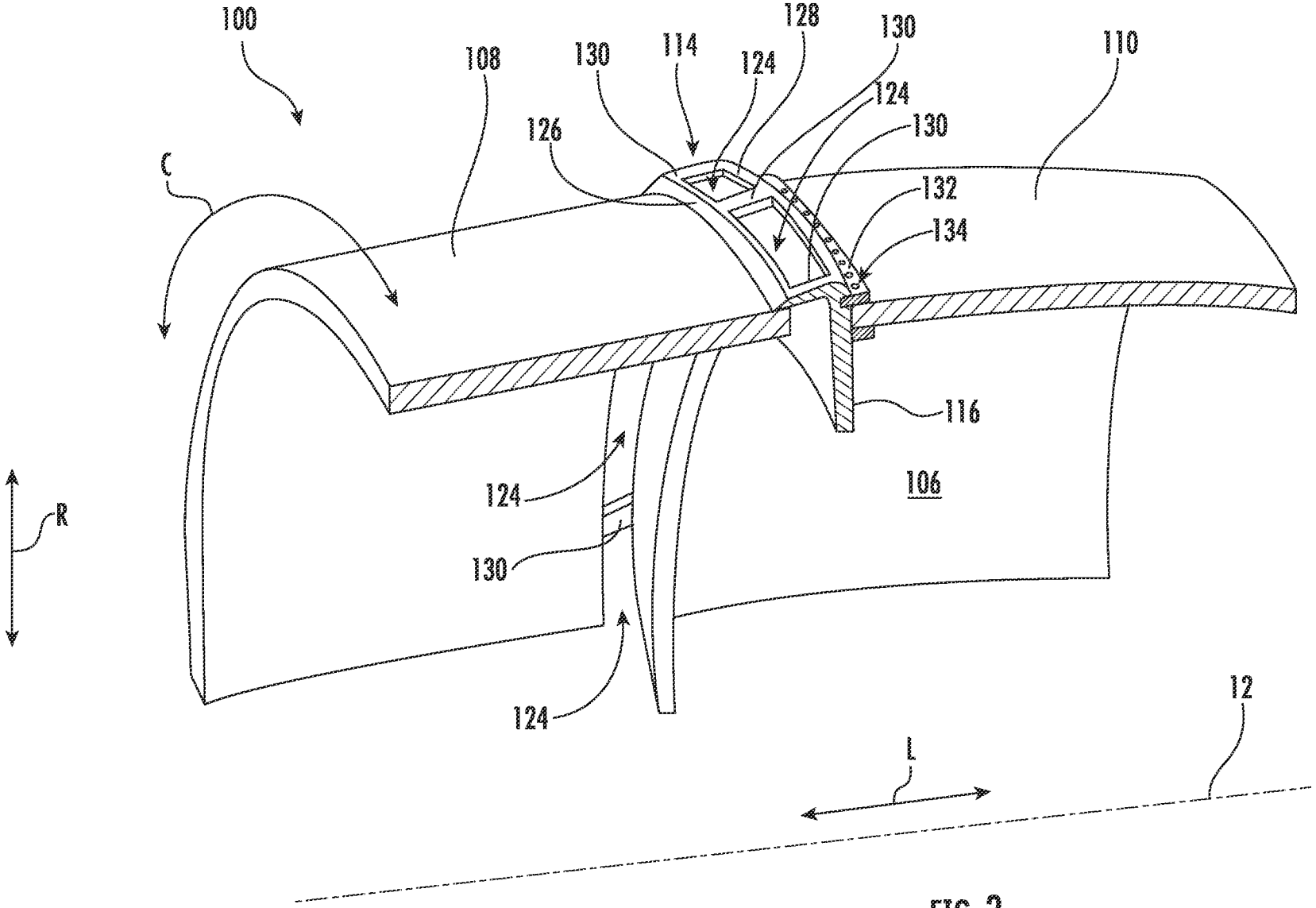
FIG. 3 is a partial perspective view of one embodiment of a combustor of a gas turbine engine.
Figure 4:
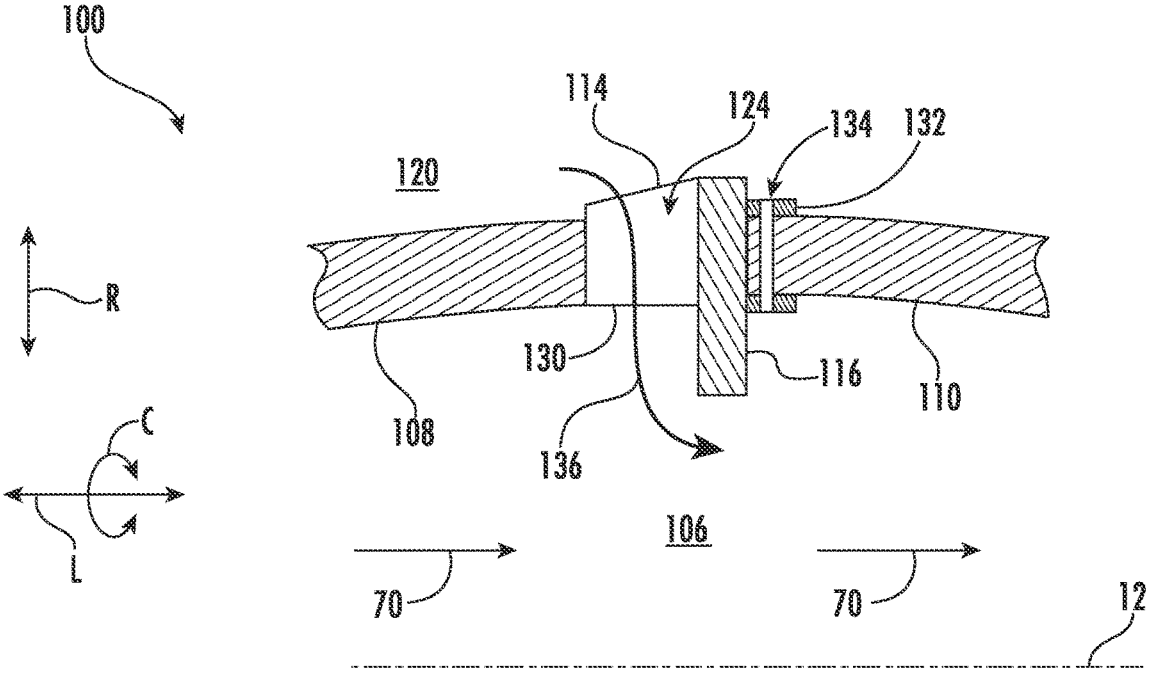
FIG. 4 is partial cross-sectional side view of the combustor shown in FIG. 3.

FIGS. 3 and 4 are differing views of one embodiment of a combustor 100 of a gas turbine engine. As mentioned above, the combustor 100 includes one or more dilution slot frames 114. Specifically, as shown, a dilution slot frame 114 is positioned between the forward and aft liner segments 108, 110 along the longitudinal centerline 12 of the engine 10 (i.e., in the longitudinal direction L). Furthermore, as shown, the dilution slot frame 114 defines a plurality of dilution slots 124 spaced apart from each other along the circumferential direction C. In several embodiments, the dilution slots 124 are arranged around the circumference of the combustor 100 such the dilution slots 124 provide an annular ring of dilution air to the combustion chamber 106. As will be described below, the annular ring of air delivered to the combustion chamber 106 by the dilution slot frame 114 reduces the $NO_x$ emissions of the engine 10.

In general, the dilution slot frame 114 includes various frame members defining each of the dilution slots 124. For example, as shown, in some embodiments, the dilution slot frame 114 includes forward and aft circumferential frame members 126, 128 extending around the combustor 100 in the circumferential direction C. Moreover, the aft circumferential frame member 128 is spaced apart from and positioned aft of (i.e., relative to the direction of flow of the combustion gases 70) the forward circumferential frame member 126. The dilution slot frame 114 also includes a plurality of longitudinal frame members 130 extending along the longitudinal axis 12 (i.e., in the longitudinal direction L) from the forward circumferential frame member 126 to the aft circumferential frame member 128. Furthermore, the longitudinal frame members 130 are spaced apart from each in the circumferential direction C around the circumference of the combustor 100. Thus, in such embodiments, each dilution slot 124 is defined between the forward and aft circumferential frame members 126, 128 in the longitudinal direction L and between a pair of adjacent longitudinal frame members 130 in the circumferential direction C. As such, each dilution slot 124 extends in the longitudinal and circumferential directions L, C. However, as will be described below, the dilution slot frame 114 may have any other suitable configuration defining a plurality of dilution slots 124 provide an annular ring of dilution air to the combustion chamber 106.

The dilution slots 124 may be of any suitable size that permits an annular ring of air to be delivered to the combustion chamber 106. For example, in some embodiments, each dilution slot 124 is at least three times longer in the circumferential direction C than in the longitudinal direction L.

Additionally, the dilution slot frame 114 may define any suitable number of dilution slots 124 that permits an annular ring of air to be delivered to the combustion chamber 106. For example, in some embodiments, the dilution slot frame 114 may define between 0.2 and 20 times as many dilution slots 124 as the number of fuel nozzle 112 within the combustor 100.

Moreover, the dilution slot frame 114 may be coupled to the forward and aft liner segments 108, 110 in any suitable manner. For example, as shown, in several embodiments, the dilution slot frame 114 may be coupled to the aft liner segment 110 via a grommet 132. In some embodiments, the aft liner segment 110 and the grommet 132 define a plurality of cooling holes 134 spaced apart from each other along the circumferential direction C. As such, the cooling holes 134 may fluidly couple the compressor discharge plenum 120 and the combustion chamber 106. For example, in one embodiment, the cooling holes 134 may be spaced apart from each other by a distance of one to three times the diameter of the holes 134.

Figure 5:
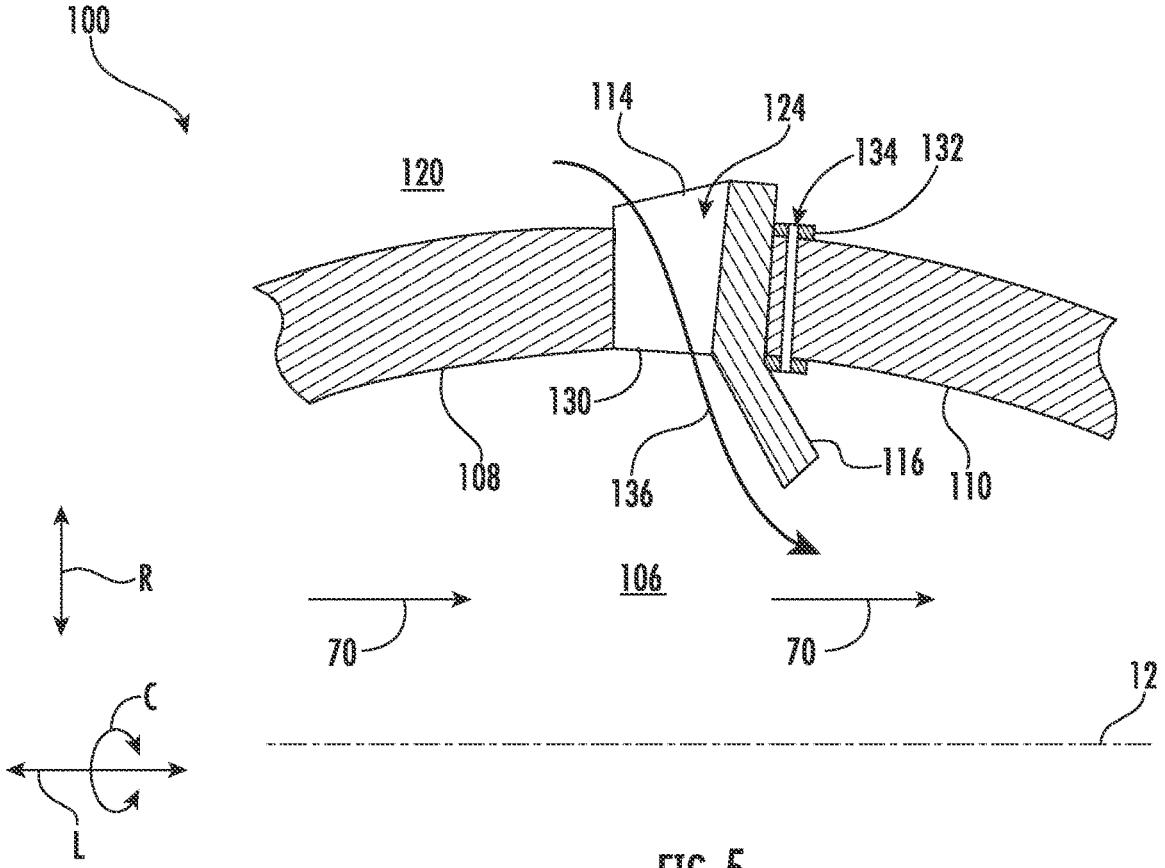
FIG. 5 is a partial cross-sectional side view of another embodiment of a combustor of a combustion section of a gas turbine engine.

Furthermore, as mentioned above, the combustor 100 may include one or more fences 116. For example, as shown, a fence 116 is positioned adjacent to the dilution slot frame 114 and extends into (e.g., inward) the combustion chamber 106 along the radial direction R. Specifically, in several embodiments, the fence 116 is positioned aft (i.e., relative to the direction of flow of the combustion gases 70) of the dilution slots 124. In this respect, as will be described below, the fence 116 directs the dilution air entering the combustion chamber via the dilution slots 124 toward the center of the combustion chamber 106. In some embodiments, as shown in FIGS. 3 and 4, the fence 116 extends into the combustion chamber 106 such that the fence 116 is oriented perpendicular to the longitudinal axis 12 of the engine 10. In other embodiments, as shown in FIG. 5, the fence 116 extends into the combustion chamber 106 such that the fence 116 is oriented an oblique angle relative to the longitudinal axis 12 of the engine 10. For example, in such embodiments, the fence 116 may be angles in the direction of flow of the combustion gases 70 or opposite to the direction of flow of the combustions gases 70. Additionally, in the illustrated embodiment, the fence 116 is integrally formed with the dilution slot frame 114. However, in alternative embodiments, the fence and the dilution slot frame 114 may be separate components.

Referring to FIG. 4, the dilution slot frame 116 and the fence 116 provide dilution air (indicated by arrows 136) to the combustion chamber 106 of the combustor 100 to reduce the $NO_x$ emission of the engine 10. More specifically, as shown, the dilution air 136 flows from the compressor discharge plenum 120 through the dilution slots 124 and into the combustion chamber 106 downstream from the fuel nozzle(s) 112. Unlike conventional combustors, which provide discrete jets of the dilution air to the combustion chamber, the arrangement of the dilution slots 124 around the circumference of the combustor 100 and the size/shape of the dilution slots 124 provide an annular ring of the dilution air 136 to the combustor chamber 106. This annular ring of dilution air 136, in turn, prevents the formation of hot spots within the combustion chamber 106, thereby allowing a greater reduction in $NO_x$ emissions than conventional combustors. Additionally, the fence 116 directs the dilution air 136 entering the combustion chamber 106 via the dilution slots 124 toward the center of the combustion chamber 106. Furthermore, the fence 116 increases the turbulence within the combustion chamber 106. In this respect, the fence 116 provides more quicker and more uniform mixing of the dilution air 136 and the combustor gases 70, thereby further reducing $NO_x$ emissions. Additionally, the cooling holes 134 may deliver compressed air from the compressor discharge plenum 120 to the aft side of the fence 116, thereby cooling the fence 116.

Figure 6:
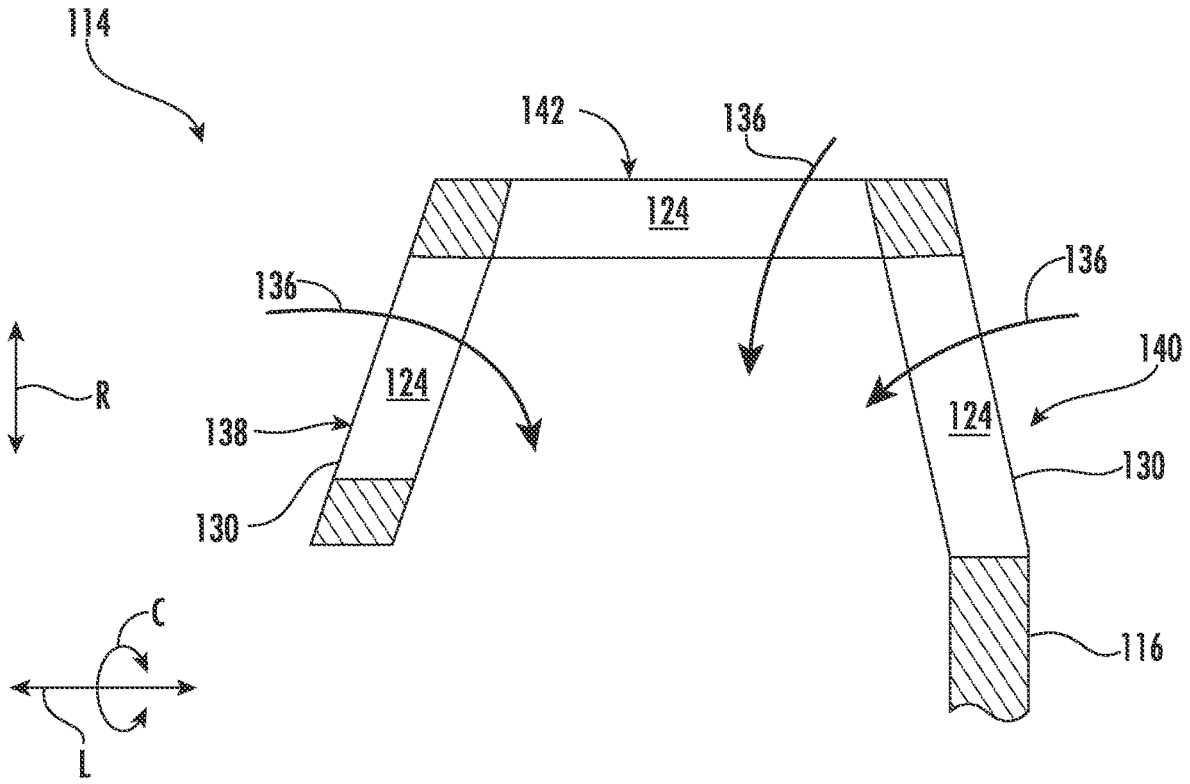
FIG. 6 is a cross-sectional side view of one embodiment of a dilution slot frame for use within a combustor of a combustion section of a gas turbine engine.

FIG. 6 illustrates another embodiment of the dilution slot frame 114. Like the embodiments of the dilution slot frame 114 shown in FIGS. 3-5, the dilution slot frame 114 shown in FIG. 6 defines a plurality of dilution slots 124 spaced apart from each other in the circumferential direction C. However, unlike the embodiments of the dilution slot frame 114 shown in FIGS. 3-5, the dilution slot frame 114 shown FIG. 6 defines a plurality of rows of dilution slots 124. The rows of dilution slots 124 are, in turn, spaced apart from each other along the longitudinal axis 12 (i.e., in the longitudinal direction L). For example, as shown, in the illustrated embodiment, the dilution slot frame 114 defines a first or forward row 138 of dilution slots 124, a second or aft row 140 of dilution slots 124, and a third or center row 142 of dilution slots 124. In this respect, each dilution slot 124 in the forward and aft rows 138, 140 extends in the radial and circumferential directions R, C. Each dilution slot 124 in the center row 142 is positioned between the dilution slots 124 in the forward and aft rows 138, 140 along the longitudinal centerline 12 (i.e., in the longitudinal direction L). As such, each dilution slot 124 in the center row 142 extends along the longitudinal centerline 12 (i.e., in the longitudinal direction L) and in the circumferential direction C. However, in alternative embodiments, the dilution slot frame 114 may have any other suitable configuration such that the frame 114 defines a plurality of dilution slots 124 providing an annular ring of dilution air to the combustion chamber 106.

Figure 7:
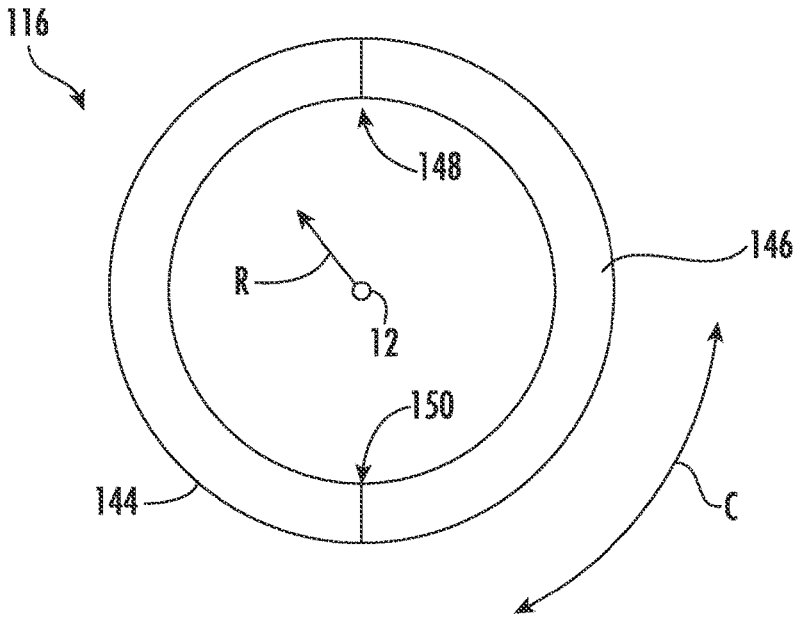
FIG. 7 is a front view of one embodiment of a fence for use within a combustor of a combustion section of a gas turbine engine.

FIGS. 7-13 illustrate various embodiments of the fence 116. For example, as shown in FIG. 7, in one embodiment, the fence 116 may include first and second fence segments 144, 146. The segments 144, 146, in turn, form arc-shaped walls that contact each other at first and second joints 148, 150 to form a continuous ring around the circumference of the combustor 100. The joints 148, 150 may be butt joints overlapping with each other with appropriate mechanical arrangement. The use of multiple fence segments 144, 146 to form the fence 116 reduces the hoop stress experienced by the fence 116.

Figure 8:
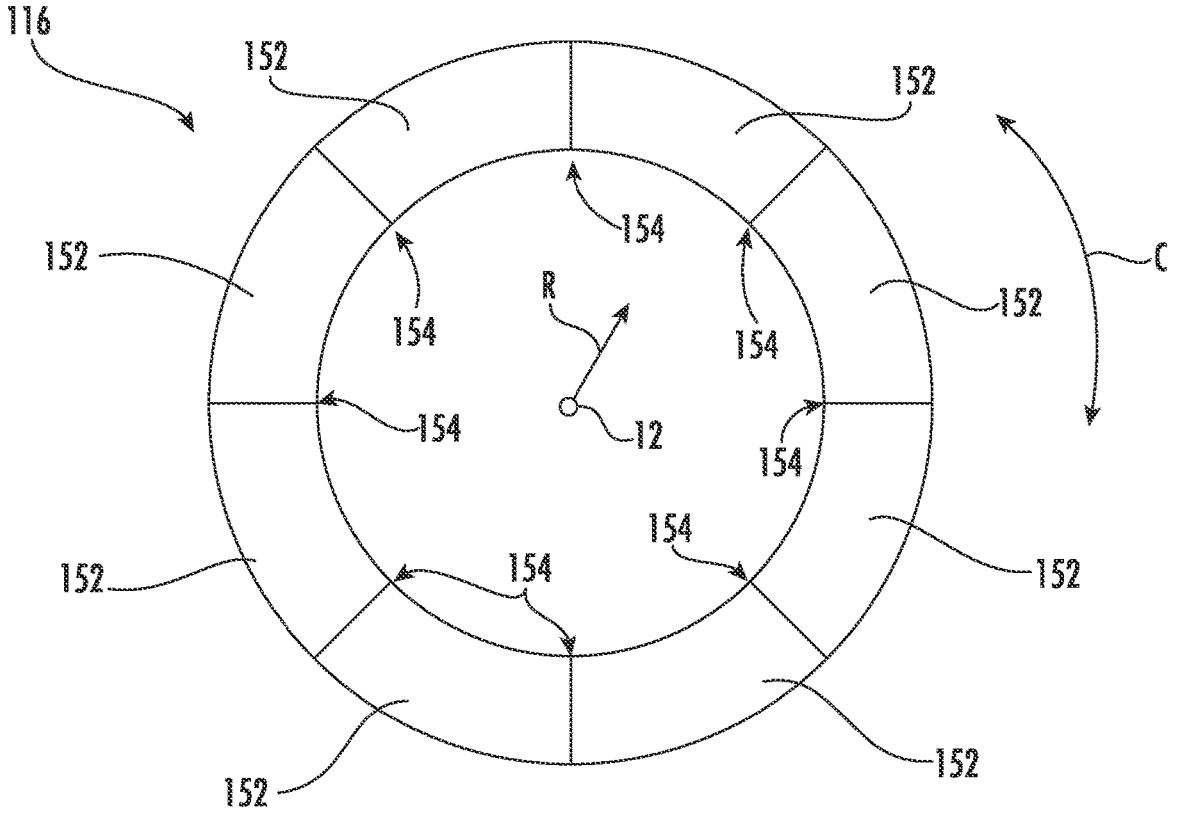
FIG. 8 is a front view of another embodiment of a fence for use within a combustor of a combustion section of a gas turbine engine.
Figure 9:
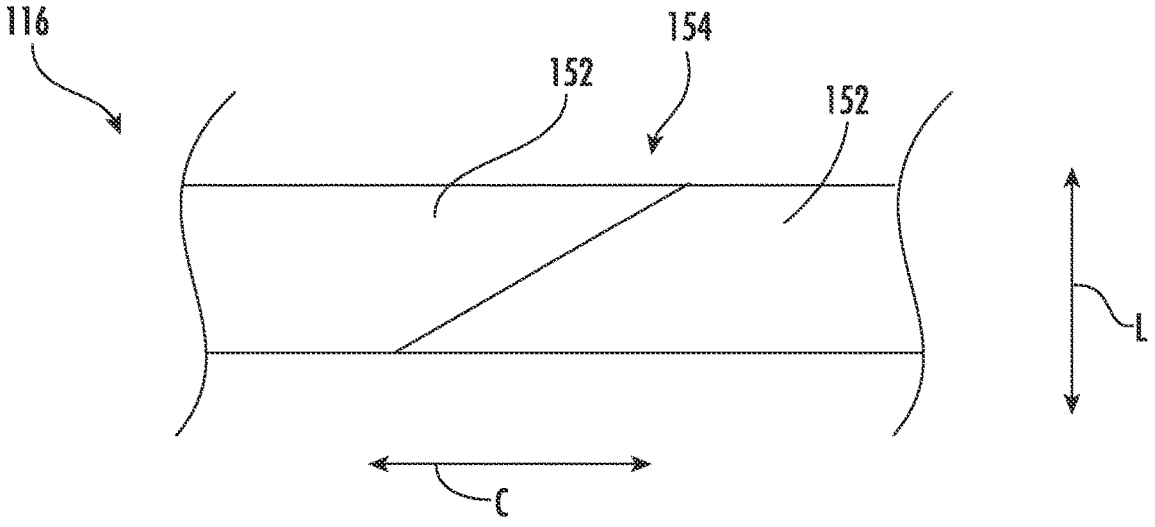
FIG. 9 is a bottom view of the fence shown in FIG. 8.

FIGS. 8 and 9 illustrate another embodiment of the fence 116. As shown, the fence 116 is formed from several fence segments 152. Specifically, each of the fence segments 152 are aligned with each other along the longitudinal centerline 12 (i.e., in the longitudinal direction L) to form a continuous ring around the circumference of the combustor 100. Moreover, each adjacent pair of fence segments partially overlaps each other in the circumferential direction 152 such that a scarf joint 154 is formed. The use of multiple fence segments 152 to form the fence 116 reduces the hoop stress experienced by the fence 116.

Figure 10:
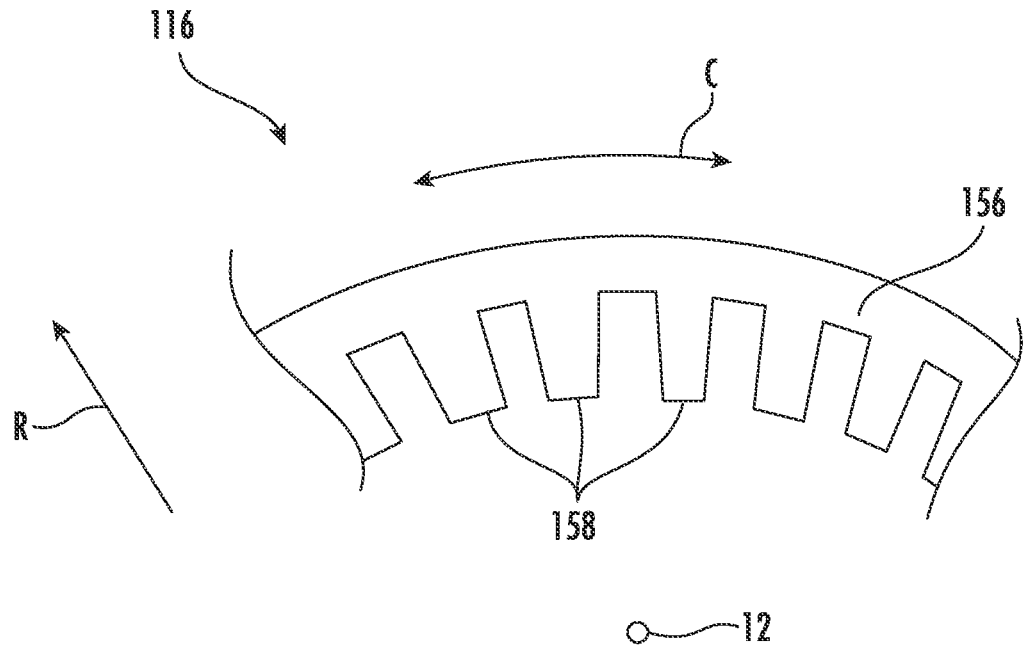
FIG. 10 is a partial front view of a further embodiment of a fence for use within a combustor of a combustion section of a gas turbine engine.

FIG. 10 illustrates a further embodiment of the fence 116. As shown, in the illustrated embodiment, the fence 116 has a comb-like configuration. Specifically, the fence 116 includes an annular base portion 156 coupled to the dilution slot frame 114 and/or the aft liner segment 110. Additionally, the fence 116 includes a plurality of teeth 158 extending from the base portion 156 in the radial direction R, with the teeth 158 being spaced apart from each other in the circumferential direction C.

Figure 11:
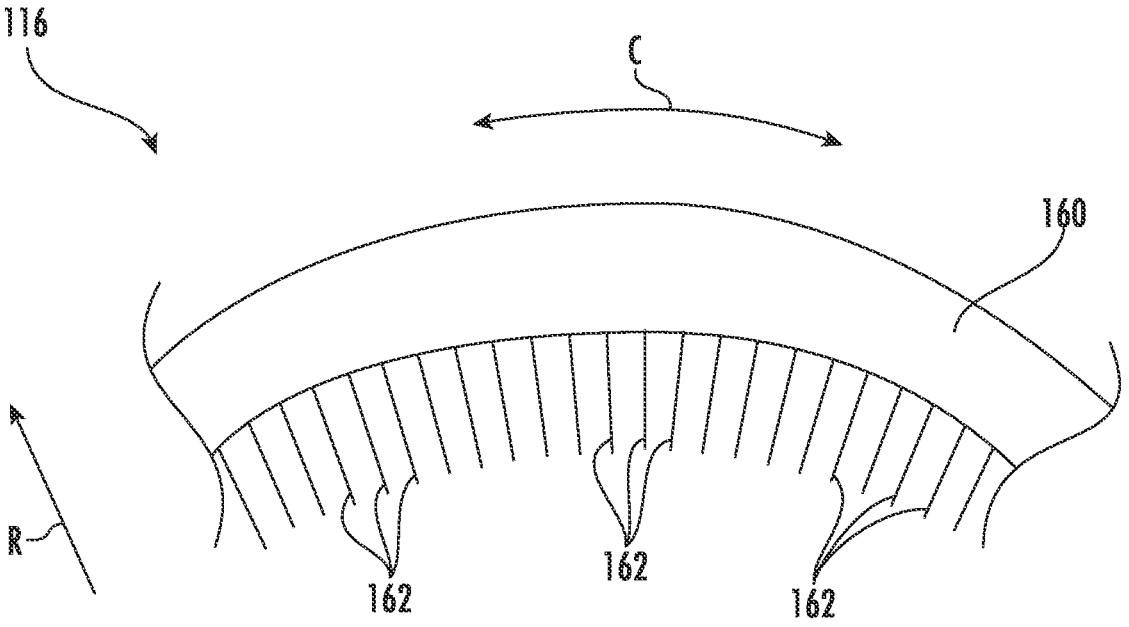
FIG. 11 is a partial front view of yet another embodiment of a fence for use within a combustor of a combustion section of a gas turbine engine.

FIG. 11 illustrates yet another embodiment of the fence 116. As shown, in the illustrated embodiment, the fence 116 has a brush-like configuration. Specifically, the fence 116 includes an annular base portion 160 coupled to the dilution slot frame 114 and/or the aft liner segment 110. Additionally, the fence 116 includes a plurality of bristles 162 extending from the base portion 160 in the radial direction R, with the bristles 162 being spaced apart from each other in the circumferential direction C and the longitudinal direction L.

Figure 12:
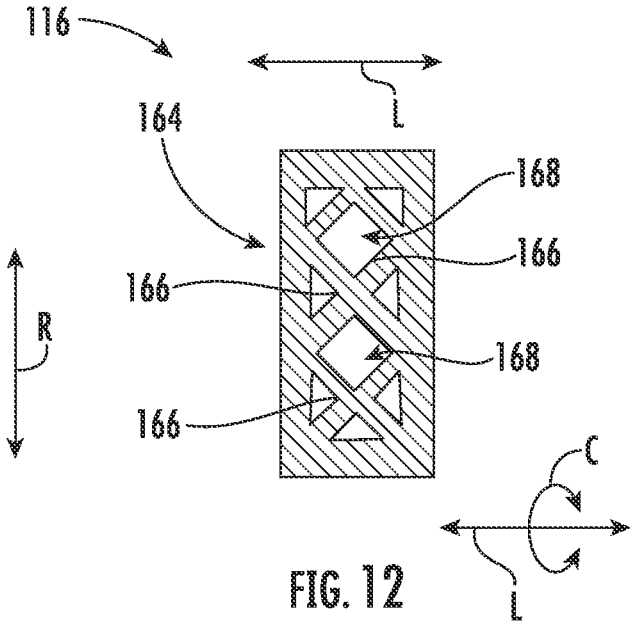
FIG. 12 is a cross-sectional side view of yet a further embodiment of a fence for use within a combustor of a combustion section of a gas turbine engine.

FIG. 12 illustrates yet a further embodiment of the fence 116. As shown, in the illustrated embodiment, the fence 116 includes an interior honeycomb portion 164. Specifically, the honeycomb portion 164 includes a plurality of walls 168 defining a plurality of voids or spaces 166 within the interior of the fence 116. The honeycomb portion 164 reduces the weight of the fence 116 and, thus, the engine 10.

Figure 13:
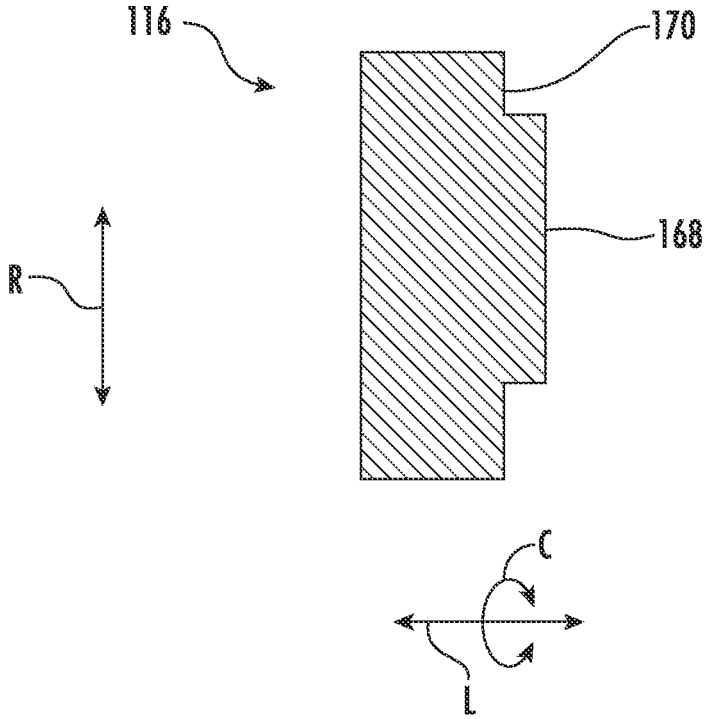
FIG. 13 cross-sectional side view of another embodiment of a fence for use within a combustor of a combustion section of a gas turbine engine.

FIG. 13 illustrates another embodiment of the fence 116. As shown, in the illustrated embodiment, the fence 116 includes a plurality of ribs 168 (one is shown) that strengthen the fence 116. Specifically, the ribs 168 extend downstream (i.e., relative to the direction of flow of the combustion gases 70 through the combustor 100) from an aft side 170 of the fence 116. Moreover, the ribs 168 increase the surface area of the aft side 170 of the fence 116, thereby increasing the effectiveness of the cooling provided to the fence 116 by the cooling holes 134 (FIGS. 3-5).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

Further aspects of the invention are provided by the subject matter of the following clauses:

A combustor for a gas turbine engine, the gas turbine engine defining a longitudinal centerline, a radial direction extending orthogonally outward from the longitudinal centerline, and a circumferential direction extending concentrically around the longitudinal direction, the combustor comprising: a forward liner segment; an aft liner segment positioned downstream from the forward liner segment relative to a direction of flow through the combustor, the forward and aft liner segments at least partially defining a combustion chamber; and a dilution slot frame positioned between the forward and aft liner segments along the longitudinal centerline, the dilution slot frame defining a plurality of dilution slots spaced apart from each other along the circumferential direction such that the plurality of dilution slots provides an annular ring of dilution air to the combustion chamber.

The combustor of one or more of these clauses, wherein the dilution slot frame comprises a plurality of frame members extending along the longitudinal centerline and being spaced apart from each other along the circumferential direction such that each adjacent pair of the plurality of frame members partially defines one of the plurality of dilution slots.

The combustor of one or more of these clauses, wherein each of the plurality of dilution slots is at least three times longer in the circumferential direction than in the longitudinal direction.

The combustor of one or more of these clauses, further comprising: a fence positioned adjacent to the dilution slot frame and extending into the combustion chamber along the radial direction.

The combustor of one or more of these clauses, wherein the fence extends inward from the dilution slot frame into the combustion chamber along the radial direction.

The combustor of one or more of these clauses, wherein the fence is oriented perpendicular to the longitudinal axis.

The combustor of one or more of these clauses, wherein the fence is oriented at an oblique angle relative to the longitudinal axis.

The combustor of one or more of these clauses, wherein the fence forms a continuous ring extending around the combustor in the circumferential direction.

The combustor of one or more of these clauses, wherein the fence comprises a plurality of segments.

The combustor of one or more of these clauses, wherein a first segment of the plurality of segments is at least partially aligned with a second segment of the plurality of segments along the longitudinal centerline.

The combustor of one or more of these clauses, wherein the first segment partially overlaps the second segment in the circumferential direction.

The combustor of one or more of these clauses, wherein the fence comprises an annular base portion and a plurality of teeth extending from the base portion in the radial direction, the plurality of teeth being spaced apart from each other in the circumferential direction.

The combustor of one or more of these clauses, wherein the fence comprises a honeycomb portion.

The combustor of one or more of these clauses, wherein the fence comprises a plurality of ribs extending downstream in the direction of flow through the combustor.

The combustor of one or more of these clauses, wherein the fence comprises an annular base portion and a plurality of bristles extending from the base portion in the radial direction.

The combustor of one or more of these clauses, wherein a first dilution slot of the plurality of dilution slots is spaced apart from a second dilution slot of the plurality of dilution slots along the longitudinal centerline.

The combustor of one or more of these clauses, wherein the first and second dilution slots extend in the radial and circumferential directions, the plurality of dilution slots including a third dilution slot positioned between the first and second dilution slots in along the longitudinal centerline, the third dilution slot extending along the longitudinal centerline and in the circumferential direction.

The combustor of one or more of these clauses, further comprising: a grommet coupling the dilution slot frame and the aft liner segment.

The combustor of one or more of these clauses, wherein the grommet and the aft liner segment define a plurality of cooling holes.

A gas turbine engine defining a longitudinal centerline, a radial direction extending orthogonally outward from the longitudinal centerline, and a circumferential direction extending concentrically around the longitudinal direction, the gas turbine engine comprising: a compressor; a turbine; and a combustor comprising: a forward liner segment; an aft liner segment positioned downstream from the forward liner segment relative to a direction of flow through the combustor, the forward and aft liner segments at least partially defining a combustion chamber; and a dilution slot frame positioned between the forward and aft liners along the longitudinal centerline, the dilution slot frame defining a plurality of dilution slots spaced apart from each other along the circumferential direction such that the plurality of dilution slots provides an annular ring of dilution air to the combustion chamber.

What is claimed is:

1. A combustor for a gas turbine engine, the gas turbine engine defining a longitudinal centerline, a radial direction extending orthogonally outward from the longitudinal centerline, and a circumferential direction extending concentrically around the longitudinal direction, the combustor comprising:

a forward liner segment;

an aft liner segment positioned downstream from the forward liner segment relative to a direction of flow through the combustor, the forward and aft liner segments at least partially defining a combustion chamber;

a dilution slot frame positioned between the forward and aft liner segments along the longitudinal centerline, the dilution slot frame defining a plurality of dilution slots spaced apart from each other along the circumferential direction such that the plurality of dilution slots provides an annular ring of dilution air to the combustion chamber; and a grommet coupling the dilution slot frame and the aft liner segment.

2. The combustor of claim 1, wherein the grommet and the aft liner segment define a plurality of cooling holes.

3. The combustor of claim 1, further comprising:

a fence positioned adjacent to the dilution slot frame and extending into the combustion chamber along the radial direction.

4. The combustor of claim 3, wherein the fence extends inward from the dilution slot frame into the combustion chamber along the radial direction.

5. The combustor of claim 3, wherein the fence is oriented perpendicular to the longitudinal axis.

6. The combustor of claim 3, wherein the fence is oriented at an oblique angle relative to the longitudinal axis.

7. The combustor of claim 3, wherein the fence comprises a plurality of segments.

8. The combustor of claim 7, wherein a first segment of the plurality of segments is at least partially aligned with a second segment of the plurality of segments along the longitudinal centerline.

9. The combustor of claim 8, wherein the first segment partially overlaps the second segment in the circumferential direction.

10. The combustor of claim 3, wherein the fence comprises a plurality of ribs extending downstream in the direction of flow through the combustor.

11. The combustor of claim 3, wherein the fence comprises an annular base portion and a plurality of bristles extending from the base portion in the radial direction.

12. The combustor of claim 1, wherein a first dilution slot of the plurality of dilution slots is spaced apart from a second dilution slot of the plurality of dilution slots along the longitudinal centerline.

13. The combustor of claim 12, wherein the first and second dilution slots extend in the radial and circumferential directions, the plurality of dilution slots including a third dilution slot positioned between the first and second dilution slots in along the longitudinal centerline, the third dilution slot extending along the longitudinal centerline and in the circumferential direction.

14. The combustor of claim 1, wherein the dilution slot frame comprises a plurality of frame members extending along the longitudinal centerline and being spaced apart from each other along the circumferential direction such that each adjacent pair of the plurality of frame members partially defines one of the plurality of dilution slots.

15. The combustor of claim 1, wherein each of the plurality of dilution slots is at least three times longer in the circumferential direction than in the longitudinal direction.

16. A gas turbine engine defining a longitudinal centerline, a radial direction extending orthogonally outward from the longitudinal centerline, and a circumferential direction extending concentrically around the longitudinal direction, the gas turbine engine comprising:

a compressor;

a turbine; and a combustor comprising:

a forward liner segment;

an aft liner segment positioned downstream from the forward liner segment relative to a direction of flow through the combustor, the forward and aft liner segments at least partially defining a combustion chamber;

a dilution slot frame positioned between the forward and aft liners along the longitudinal centerline, the dilution slot frame defining a plurality of dilution slots spaced apart from each other along the circumferential direction such that the plurality of dilution slots provides an annular ring of dilution air to the combustion chamber; and a grommet coupling the dilution slot frame and the aft liner segment.

17. A combustor for a gas turbine engine, the gas turbine engine defining a longitudinal centerline, a radial direction extending orthogonally outward from the longitudinal centerline, and a circumferential direction extending concentrically around the longitudinal direction, the combustor comprising:

a forward liner segment;

an aft liner segment positioned downstream from the forward liner segment relative to a direction of flow through the combustor, the forward and aft liner segments at least partially defining a combustion chamber;

a dilution slot frame positioned between the forward and aft liner segments along the longitudinal centerline, the dilution slot frame defining a plurality of dilution slots spaced apart from each other along the circumferential direction such that the plurality of dilution slots provides an annular ring of dilution air to the combustion chamber; and a fence positioned adjacent to the dilution slot frame and extending into the combustion chamber along the radial direction, the fence including an annular base portion and a plurality of teeth extending from the base portion in the radial direction, the plurality of teeth being spaced apart from each other in the circumferential direction.

18. The combustor of claim 17, further comprising:

a grommet coupling the dilution slot frame and the aft liner segment such that the grommet and the aft liner segment define a plurality of cooling holes.

19. The combustor of claim 17, wherein the fence extends inward from the dilution slot frame into the combustion chamber along the radial direction.

20. The combustor of claim 17, wherein the fence is oriented perpendicular to the longitudinal axis.

* * * * *